United States Patent [19]

Marlow

[11] 4,202,654

[45] May 13, 1980

[54] WEAR RESISTANT SELF LUBRICATING CENTRIFUGAL PUMP

[76] Inventor: Alfred S. Marlow, 274 Robindale Dr., Leola, Pa. 17540

[21] Appl. No.: 755,253

[22] Filed: Dec. 29, 1976

[51] Int. Cl.[2] ..... F01D 11/00; F01D 5/14

[52] U.S. Cl. ..... 415/113; 415/212 A; 415/197; 415/206; 415/170 R

[58] Field of Search ..... 415/196, 197, 201, 204, 415/217, 216, 170 R, 170 A, 116, 111, 113; 277/74, 205, 1, 3, 15, 212 R, 212 F, 212 C; 184/54; 285/205

[56] References Cited

U.S. PATENT DOCUMENTS

| | | | |
|---|---|---|---|
| Re. 12,584 | 12/1906 | Degen | 415/113 UX |
| 1,425,781 | 7/1922 | Knoderer | 285/205 UX |
| 1,850,683 | 3/1932 | Merrill | 415/197 X |
| 1,925,898 | 9/1933 | Fritz | 415/197 X |
| 2,635,549 | 4/1953 | Rupp | 415/196 UX |
| 3,194,342 | 7/1965 | Heim | 277/1 X |
| 3,247,801 | 4/1966 | Conery | 415/196 X |
| 3,279,386 | 10/1966 | Rupp et al. | 415/201 X |
| 3,451,343 | 6/1969 | Kabele | 415/201 X |
| 3,499,388 | 3/1970 | Eberhardt | 415/201 X |
| 3,543,368 | 3/1968 | Marlow | 416/87 X |
| 3,594,102 | 7/1971 | Oden | 415/170 A UX |
| 3,776,659 | 12/1973 | Coon, Jr. | 415/201 X |
| 3,829,238 | 8/1974 | Speck | 415/197 |
| 3,914,072 | 10/1975 | Rowley et al. | 415/170 A X |
| 3,954,348 | 5/1976 | Renaud | 415/113 |

*Primary Examiner*—William L. Freeh
*Attorney, Agent, or Firm*—Jerome P. Bloom

[57] ABSTRACT

A trash handling pump featuring simplicity of construction wherein the pump parts stack one upon the other and the impeller and/or its housing, the latter of which has integrated volute structure, include resilient surface portions strategically formed and located to prevent solids from fixedly lodging therebetween and thereby causing the parts to either malfunction or break. As here provided, the impeller housing has a slip fit and shock absorbing mount. The pump unit also features a self lubricating system which is automatically controlled by the pump discharge. An improved arrangement of seals insures against leaking of lubricant from the pump housing.

Preferred embodiments of the pump include a two part impeller housing embodying volute structure in each part thereof. The arrangement is such that the parts may be easily molded of plastic materials.

18 Claims, 10 Drawing Figures

1a
32
30
12
4
7
9
8
1b
1
70
3
30
10
5
6
28a
29
45
2
37
39
57
69
28
76
75
40
74
44
3a
3b
41
51
72
60
58
11
27
18
52
50
73
61
49
16
22
68
64
20
23
24
25
53
67
26
63
62
17
19
65
51
21
18
38
66
37
35
59
46
10
77
1a
1b

WEAR RESISTANT SELF LUBRICATING CENTRIFUGAL PUMP

BACKGROUND OF THE INVENTION:

This invention relates to improvements in self-priming centrifugal pumps reducing wear in such pumps and providing them with an extended operating life as well as a capability of pumping, without perceptible damage, liquids entraining a great variety of particulate solid materials, such as sand, pebbles, small stones, gravel and the like. A pump embodying the features of the present invention has been found capable of handling solids as large as one-half the pipe size of the pump. It is therefore particularly advantageous for use as a trash handling pump and will be so described, but only by way of example and not by way of limitation.

While the prior art has produced numerous trash handling pumps they have presented serious maintenance problems in their use. They are normally plagued with early and severe damage to their impeller and volute structures due to the nature and character of the materials which they pump. In many cases their design is such, moreover, that their seals depend for lubrication on the dirty liquid which is passed through the pump. Under such circumstances it has been found that the pump seals tend to quickly deteriorate. In these respects the design of prior art trash handling pumps has been something less than satisfactory.

It is to the solution of the aforementioned problems as well as the provision of a simplified construction for a centrifugal pump that the present invention is directed.

For art of pertinence to the present invention, attention is directed to U.S. Pat. No. 3,543,368.

SUMMARY OF THE INVENTION

The centrifugal pump of the present invention is characterized by a simplified construction. It may be made up, in its entirety, of stampings, castings, plastic moldings and moldings of rubber or elastomeric material. In preferred embodiment the operating parts thereof are contained in a two-piece housing which may be readily sealed and easily opened for maintenance or inspection purposes. The check valve at the inlet or suction port of the housing has an improved construction.

In connection with the shaft which drives the impeller of the pump is a double seal and in association therewith a lubrication system which is automatically activated by the pressure developed within the housing of the pump as it serves its normal function. The impeller and volute assembly of the pump are constructed to be easily applied and readily removed. The impeller features a resilient coating and the volute assembly a backing the nature and operating relation of which is such to materially increase their working life and to minimize the chance of damage by the solid particulate material being handled by the pump. As arranged, the impeller and volute assembly have a capacity to readily accommodate the handling and passage of particulate solids of significant size, the nature of which have heretofore caused severe wear and damage in conventionally constructed trash handling pumps.

A most preferred embodiment of the present invention features an improved impeller and volute assembly which facilitates and simplifies the installation and maintenance of these parts. The volute assembly, moreover, is fabricated as a two-part plastic unit forming an improved housing for the pump impeller. In accordance with the invention this unit is installed in a manner to give it a limited floating mount in the pump housing in which it is embodied. The features of improvement here noted lend a pump a more useful and considerably extended operating life substantially free of chance of malfunction, during which life maintenance requirements are reduced to a minimum.

It is accordingly a primary object of the present invention to provide a pump capable of handling "trash" which is economical to manufacture, more efficient and satisfactory in use, adaptable to a wide variety of applications and unlikely to malfunction.

Another object of the invention is to provide an improved centrifugal pump featuring an improved two-part volute assembly provided with a floating mount.

A further object is to provide centrifugal pumps with an improved self-pressurized lubrication system.

Another object is to provide a centrifugal pump, particularly advantageous for the handling of trash, with an improved impeller and volute assembly and a mount thereof the nature of which is to substantially reduce conventionally expected wear and damage to the elements of the pump when applied to the handling of liquids, embodying significant amounts of particulate solids.

Another object of the invention is to provide a centrifugal type pump which includes improved seals and an arrangement thereof which distinctly separates the inlet chamber portion of the pump from its discharge chamber to lend the pump an ability to achieve its maximum operating efficiency.

A further object of the invention is to provide a centrifugal type pump and parts thereof possessing the advantageous structural features, the inherent meritorious characteristics and the means and mode of use and application herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention, FIG. 1 is a cross sectional view of a centrifugal pump embodying features of the present invention, illustrating a fragment of a prime mover to which the pump is affixed;

Figures 1, 4:
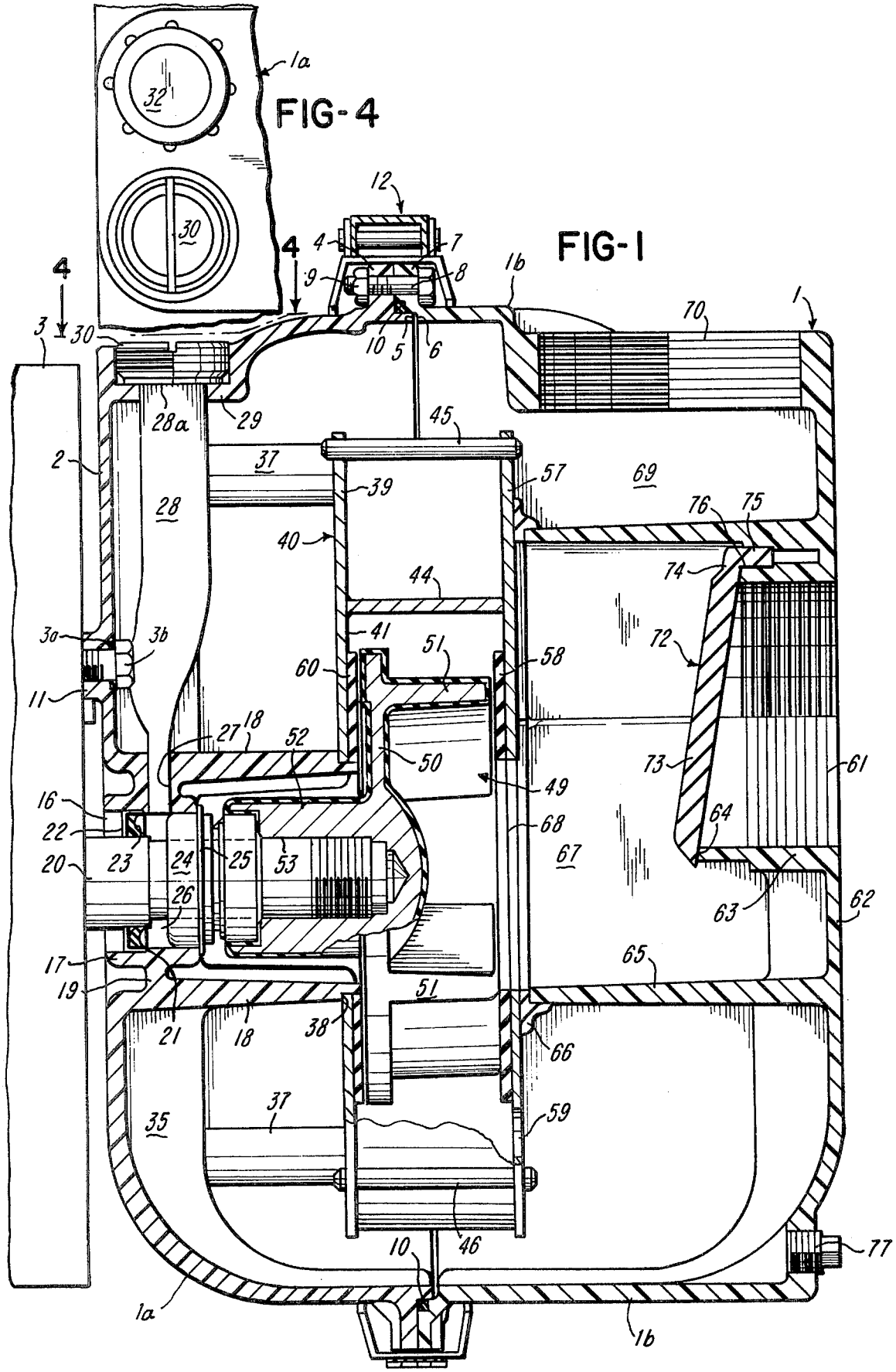
FIG. 4 is a fragmentary view taken on line 4—4 of FIG. 1.

With reference to the accompanying drawings, two substantially cup-shaped parts 1*a* and 1*b* are brought together to have the respective lips thereof in face abutting relation, to form thereby the pump housing 1.

For convenience of this disclosure, part 1*a* will be described as the rear half of the housing since the base 2 thereof will position adjacent and in connection with the prime mover of the pump. The part 1*b*, the base 62 of which will be positioned remote from the prime mover, will be described as the front half of the housing.

At the open ends thereof the parts 1*a* and 1*b* are complementarily shaped to nest, one relative the other. The peripheral wall of the part 1*a* is provided with an outwardly projected circumferentially extending flange 4 located in a plane which is in adjacent spaced relation to its lip 5. The lip 6 of the part 1*b* has integral therewith a circumferentially extending external flange 7. The configuration of flange 7 is such that it is offset outwardly and forwardly of the lip 6 to provide that as the lips 5 and 6 are brought together the flange 7 will seat to the flange 4 and in immediately surrounding relation to the lip 5. The radially innermost portion of the face of the flange 7 which abuts the flange 4 is provided with a circumferential notch to accommodate therein an O-ring type seal 1. The latter serves, in the abutment of the flanges 4 and 7, and the coupling thereof, to form a liquid tight seal as between the housing parts 1*a* and 1*b*.

The flanges 4 and 7 are provided with circumferentially spaced apertures which are mated in the coupling of the parts 1*a* and 1*b*. Each mated pair of these apertures has thrust therethrough a bolt 8 the head of which, as illustrated, abuts the flange 7 while the remote projected extremity of which is engaged by a nut 9. As the nuts 9 are turned up on the bolts 8 and clamped to the surface of the flange 4 remote from the flange 7, a liquid tight seal of the joint between the parts 1*a* and 1*b* is insured.

Figure 2:
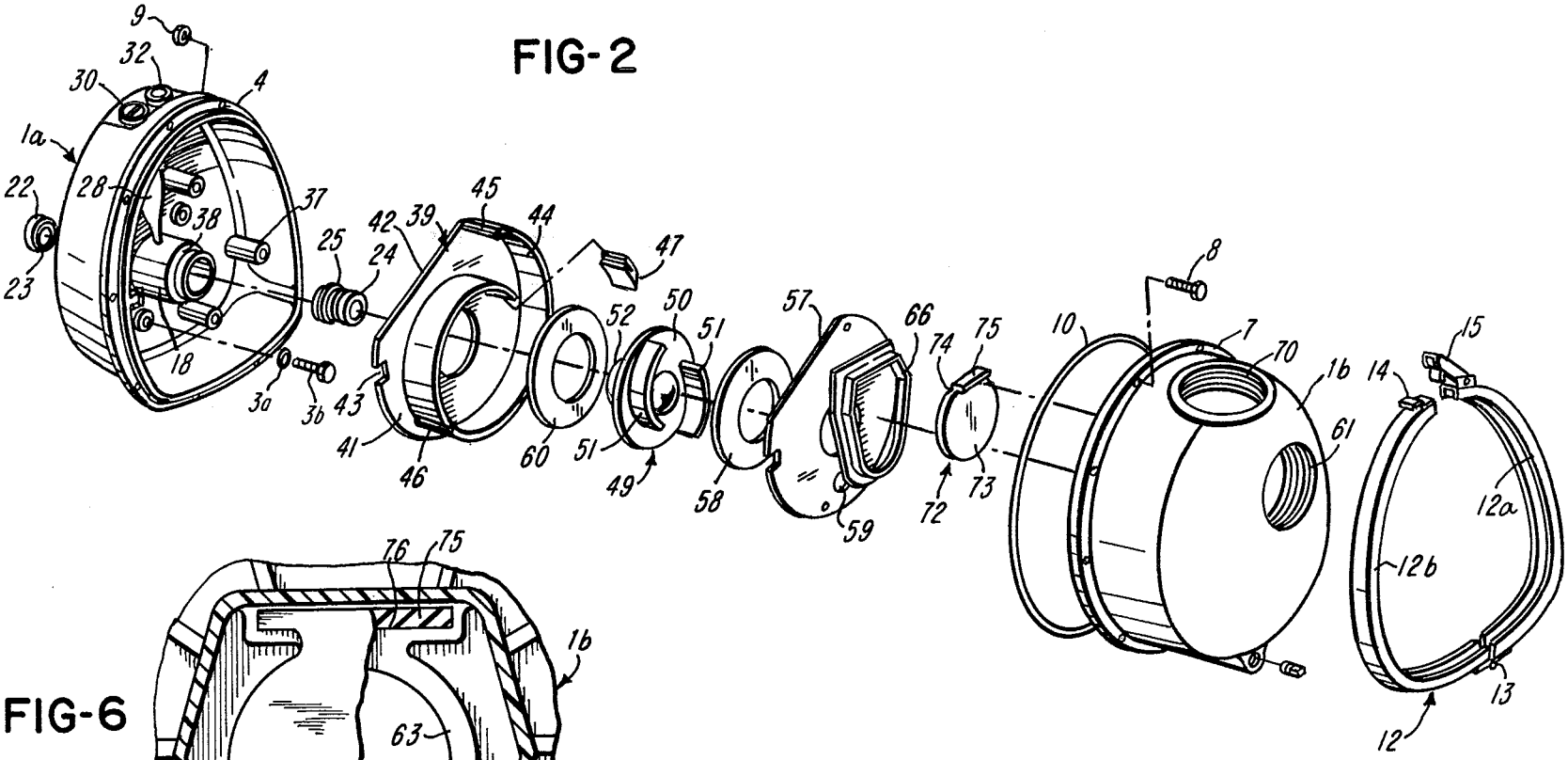
FIG. 2 is an exploded perspective view of the pump of FIG. 1.

In the embodiment illustrated in FIG. 1 the joint between the parts 1*a* and 1*b* is circumscribed by a locking band 12. This band may be made up of two or more articulated segments. However, as shown it is comprised of two arcuately configured segments 12*a* and 12*b* hinged together by a pivot pin 13. In transverse section the channel shaped segments 12*a* and 12*b* have a generally U-shaped configuration with divergent sides. At the end thereof remote from the pivot 13 the segment 12*b* is shown to mount a strike plate 14 having an angularly offset hook-like end portion for engagement by a pivotally mounted cooperatively shaped latch element 15 in connection with the free end of the segment 12*a*. The latch element 15 is part of a conventional latching unit, well known to those versed in the art, providing that it may be swung over, engaged with and locked to the element 14 in a tensioned arrangement. The details of the latch means are not further described since in and of themselves they form no particular part of the present invention. It will of course be obvious from FIGS. 1 and 2 that the segments of the band 12 may be easily applied to nest the coupled flanges 4 and 7 as well as their coupling means, the latter being accommodated by the divergent relation of the sides of the channel shaped elements. Once the segments of the band 12 are applied to nest about the joint between the parts 1*a* and 1*b*, their latch elements may be interconnected and interlocked as described, whereupon the joint between the parts 1*a* and 1*b* will be protected and the bolts and nuts will be shielded from encrustation and premature rusting in the operation of the pump.

As an alternative to the use of the bolts 8 and nuts 9, a locking band such as 12 may have the inner surfaces of the sides of its channel-shaped members 12*a* and 12*b* configured so that in the application thereof they wedge and clamp the flanges 4 and 7 in face abutting relation with the seal 10 therebetween.

In the connection of the illustrated pump to its prime mover, tubular bosses 11 formed integral with the base 2 project outwardly therefrom and seat on and in end abutted relation to the prime mover housing 3. The ends of the bosses innermost of the base 2 seat O-ring seals 3*a* abutted and clamped to the base 2 by the heads of bolts 3*b* the bodies of which are thrust through the bosses to threadedly engage in the housing 3. The base 2 is thus anchored to the prime mover.

The base 2 is provided with a passage 16 defined by a short tubular wall segment 17 held within and in concentric spaced relation to the outermost end of a relatively longer tubular wall segment 18 by a circumferentially extending integrally connected radial web 19. The tubular wall segments 17 and 18 extend inwardly of the housing half 1*a* in a sense perpendicular to the base 2. The outermost end of the segment 18 merges with the base 2 and together with the web 19 and the interconnected segment 17 forms an extension thereof. The inner surface of the wall segment 18 is provided with a series of longitudinally extending ribs which are circularly spaced.

In its assembly to the prime mover the base 2 of the housing half 1*a* accommodates the projection through the passage 16 of the prime mover drive shaft 20. The outermost end of the inner wall surface of the segment 17 is stepped to form thereon an outwardly facing shoulder 21 enabling it to nest thereon and about the drive shaft 20 a two-part ring seal. This ring seal includes a relatively rigid, centrally apertured, cap-shaped element 22 which is fixed within the wall segment 17 to have its outer peripheral wall in engagement therewith while the lip thereof seats to the outer peripheral edge of the shoulder 21. Nested within the element 22 is a generally ring-shaped resilient, flexible, sealing element 23. The configuration and dimension of the sealing element 23 is such that in the application thereof its inner edge angles away from the base of the element 22 and is inherently biased to seat against and about and in sealing relation to the shaft 20 which is passed therethrough as it is directed interiorly of the pump housing 1. Thus, noting FIG. 1, in cross section the flexible sealing element 23 is cupped and so arranged that any pressure applied thereto from the interior of the pump housing will cause it to expand and more firmly seat in sealing relation to and about the shaft 20 as well as to the peripheral wall of the element 22 in which it nests.

In the assembly of the pump structure a bearing type seal 24 intermediate the length of which is a radially projected flange 25 is applied over the innermost end of the shaft 20. In the application of the seal 24 one end thereof nests in the innermost end of the wall segment 17 to position in end spaced relation to the flexible seal 23. The position of the outermost end of the seal 24 is determined by the overlapping abutment of its flange 25 to the innermost end of the segment 17. The end spaced relation of the elements 23 and 24 produces therebetween an annular chamber 26 an opening to which is provided by a generally radial aperture 27 extending through the wall segments 17 and 18 and the interconnecting web structure 19.

Secured in the aperture 27 to its rimming wall structure is one open end of a flexible tube-like element 28 the opposite end of which passes through a generally aligned opening in a recessed flatted wall portion 29 in a peripheral side wall portion of the housing half 1*a*. Immediately outward of the recessed wall portion 29 an external flange 28*a* on the other extremity of the tube seats thereto. As shown the flange 28*a* positions at the top of the pump and defines the inlet to the tube 28 which is filled with lubricating oil. The recessed side wall portion 29 is rimmed by a perpendicularly projected threaded wall portion in which is threadedly engaged a cylindrical plug element 30. The latter serves to clamp flange 28*a* to the wall portion 29 and to cap the inlet opening of the tube 28 whereupon the only opening from the tube 28 is to the annular chamber 26 between the sealing elements 23 and 24.

The peripheral wall of the housing half 1*a* has a further aperture forming a filler port for applying priming liquid to the interior of the pump. This aperture is located in side by side spaced relation to the opening to the tube 28 which is capped by the plug 30. The filler port is capped by a plug-like closure element 32.

The housing half 1*a* as well as the housing half 1*b* is formed of high impact strength plastic. In the formation of the housing half 1*a* its interior surface is molded to include a series of relatively projected ribs. These ribs include a generally circular rib 34 positioning in concentric, radially and outwardly spaced relation to the tube segment 18. Intersecting the rib 34 and extending to either side thereof is a plurality of radial ribs 35 which intersect the rib 34 at circumferentially spaced locations. Spaced intermediately of adjacent of the ribs 35 and radiating outwardly from the rib 34 are additional ribs 36.

Also formed integral with and projected perpendicular to the inner surface of the base 2 are a series of circularly spaced tubular posts 37. The inwardly projected ends of posts 37 lie in a common plane commonly occupied by a shoulder 38 formed on the outer surface of the tubular wall segment 18 by a reduction in the outer diameter of its inner end. Seating on and in abutting relation to the inwardly projected ends of the posts 37 and the shoulder 38 is an annular plate 39 forming the rear part of a volute assembly 40. The central aperture in the plate 39 permits the inner reduced end of the segment 18 to project therethrough and beyond its surface 41 which positions innermost of the housing half 1*a*. The outer peripheral edge of the plate 39 is circular except for a truncated edge portion 42, adjacent to one end of which its circular edge portion is provided with a rectangular notch 43 the purpose of which will be further described. Adhesively attached to the radially innermost portion of the surface 41 of the plate 39 to position immediately about the inner end of the segment 18 is an annular sheet-like segment 60 of resilient rubber or elastomeric material.

A strip 44 of metal material spiralled into a rigid volute form has one edge welded to the face 41 of the plate 39 so that it projects in a sense perpendicular thereto. The outermost end of the spiral of the strip 44 is welded to a pin 45 connected in and to project perpendicular to the plate surface 41 at a location at that end of its truncated edge portion 42 which is remote from the notch 43. A further pin 46 similarly fixed to project perpendicular to and from the face 41 of the plate 39 is welded to an outermost surface portion of the volute 44 at a point spaced somewhat more than 180° from the pin 45. It is noted that the projection of the pins 45 and 46 with respect to the surface 41 is somewhat greater than the depth of the volute 44. The purpose of this will soon become obvious. The spiral of the strip 44 extends beyond 360° and the extent thereof is somewhat less than 450°. A cut water resilient tip element 47, formed of rubber of elastomeric material has a notch in one end accommodating its slip fit mount on and the adhesive attachment thereof to the inner end of the volute. The element 47 thereby provides a resilient projected tip on the inner end of the element 44 which is adapted to flex and afford advantages soon to become obvious.

The volute structure so provided serves to nest and encompass the outer periphery of an eccentrically positioned impeller unit 49.

The impeller unit 49 includes a shroud plate 50 forming a base for a pair of integrally connected perpendicularly projected impeller vanes 51. Integral with the face of the plate 50 opposite that from which project the vanes 51 is a generally cylindrical hub portion 52. The end of the hub 52 remote from the plate 50 is provided with a blind bore 53 the peripheral wall of which is threaded whereby to enable the impeller unit to be threaded on to the projected extremity of the drive shaft 20 which positions interiorly of the housing half 1*a* in a connection of its base 2 to the prime mover. The bore 53 is counterbored so that in the assembly of the impeller unit to the shaft 20 the projected end of the hub portion 52 will accommodate therein the end of the bearing seal 24 which is remote from the wall segment 17. In the fabrication thereof the impeller unit 49 including its hub portion 52 is provided with an outer coating of rubber or elastomeric material.

It will of course be obvious that the invention construction provides for an extremely simple assembly of the pump to and in connection with its prime mover and the drive shaft thereof. In the process, as should be self-evident, highly effective though simple seal structures are readily and easily provided to accommodate and mount about the drive shaft 20 in a manner to inhibit the movement of dirty liquid being handled by the invention pump from bypassing the volute structure and passing the seals here described. As is further evident, the volute and its base plate can be easily and quickly positioned in their required place, following which the impeller unit can be simply threaded on the drive end of the shaft 20 to nest within and be peripherally encased by the inner spiral portion of the volute. Once this is achieved, the impeller is simply contained by the application to the volute structure of a front or outer annular plate 57. The plate 57, formed similarly to the plate 39, includes apertures respectively to align with and receive therein end portions of the pin means 45 and 46 which project beyond the edge of the strip 44 remote from the plate 39. The pin means 45 and 46 thereby serve to properly position and mount the plate 57 in alignment with the plate 39 and to cap the impeller 49. The central aperture in the plate 57 as thus arranged provides an inlet opening in a direct line with the central pocket of the impeller which is defined within the arcuately configured impeller vanes 51. Note that there is adhesively fixed about the central opening in the plate 57, to the face thereof adjacent the vanes 51, an annular member 58 similar to the member 60 previously described. In the application of the plate 57 to contain the impeller the edges of the vanes 51 which are coated with resilient material will position in very closely adjacent relation to the member 58 while the remote face of the plate portion 50 of the impeller has the resilient coating thereof adjacent its peripheral edge in very closely adjacent relation to the resilient element 60 which is in backing relation thereto. The plate 57 includes therein, at a six o'clock position, shown in FIG. 2 of the drawings, a further aperture 59 which serves as a priming port. This enables, as will be obvious from the description of the structure and its function, that the pump of the invention is self-priming. Thus, in the design illustrated, should the pump become air bound, and there is sufficient water in the pump housing to cover the aperture 59, the water in the pump housing will flow through the priming port and try to flood the volute area and the impeller chamber. However, since the impeller is still rotating, this water will be induced by the impeller to flow through the volute structure to the pump discharge chamber and in the process it will pick up air from the impeller. In the discharge chamber the air separates from the water and the air will be discharged while the water will remain in the pump housing for priming use. This continues until the objectionable air is evacuated and at that point, since the priming liquid is retained in the pump housing, the pump will reestablish its original pumping operation. This self-priming action of the pump will become more evident when the foregoing is taken in conjunction with the following additional detailed description of the pump structure.

Figure 5:
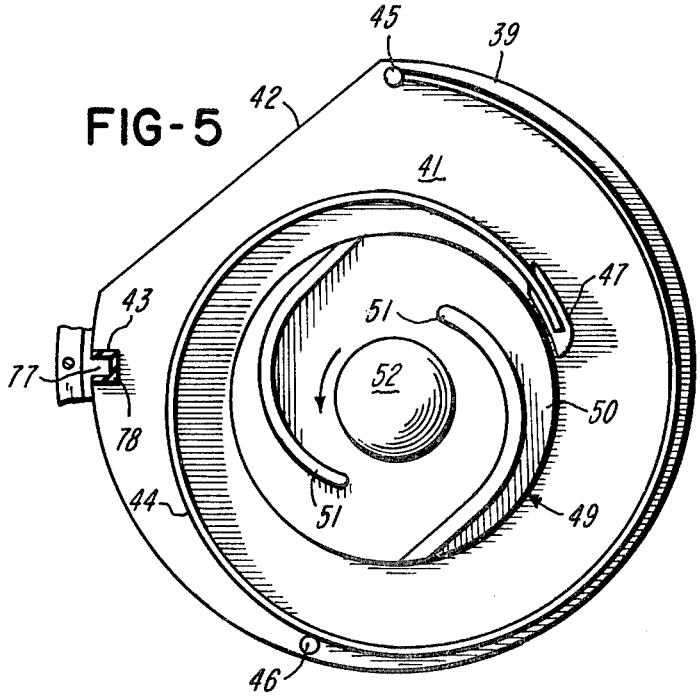
FIG. 5 is a fragmentary view illustrating the rear volute plate, the volute scroll, the cut water tip and the impeller of the pump of FIG. 1, together with detail of a shock absorbing mount for the volute assembly.

As assembled, the cup-shaped front **1*b* of the housing 1 is provided with an inlet aperture 61 in its base portion 62 which is offset from the direct alignment with the central opening in the plate 57. Formed integral with the base 62, rimming the aperture 61, and projecting inwardly thereof in a sense perpendicular thereto, is a tubular wall structure 63 the inwardly projected end portion 64 of which is obliquely angled. Also formed integral with the base 62 and projected inwardly thereof and perpendicular thereto is a further generally tubular wall segment 65. The latter surrounds, positions eccentrically of and projects inwardly of the base 62 a substantial distance beyond the inwardly projected end of the wall structure 63. A resilient gasket 66 having a loop-shaped configuration includes a portion which mounts on and over the inwardly projected extremity of the wall segment 65 and projects radially outward therefrom and another portion which peripherally encompasses the same. The length of the wall segment 65 is such that in the clamping of the housing half 1*b* to the housing half 1*a* it will, through the medium of the interposed gasket 66, clamp to the plate 57 and secure it in capping relation to the volute structure 44 and the interiorly nested portion of the impeller unit 49. As this assembly is fully achieved, there is defined between the plate 57 and the base 62, in the area encompassed by the wall segment 65, an entrance chamber 67 communicating with the eye of the impeller 49 by way of the inlet aperture 68 provided in its enclosure, which inlet aperture is afforded by the central aperture in the plate 57 and rimmed by the resilient adhesively applied element 58. At the same time an outlet chamber 69 is provided in the pump housing peripherally and outwardly of the wall segment 65, the tubular wall segment 18 and the volute assembly. The side wall of the housing half 1*b* is provided with a pump outlet opening 70 to one side of the wall segment 65 and adjacent the base 62. The discharge passage from the volute assembly which encompasses the shroud plate 50 and the vanes 51 of the impeller 49 is provided between the overlapped relatively spaced and portions of the spiral form of the strip 44. Attention is directed to the fact, observing FIG. 5 of the drawings, that the cut water tip 47 is in immediate proximity to the radial outermost edges of the impeller vanes 51 as the impeller is rotated through the medium of its drive shaft 20**.

Figure 6:
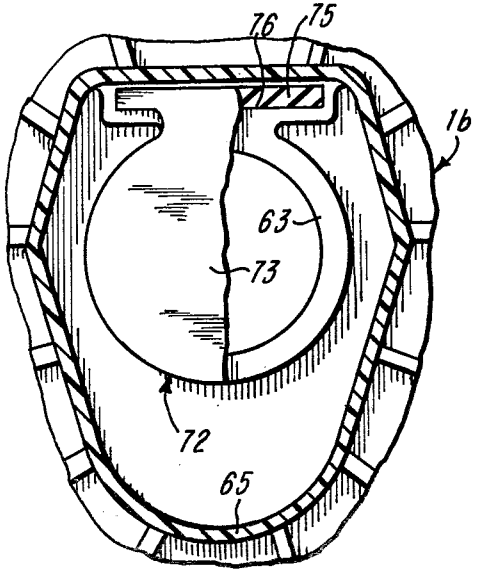
FIG. 6 is a sectional view illustrating a fragment of the pump housing embodying an improved valving element in connection with its inlet port.
Figure 3:
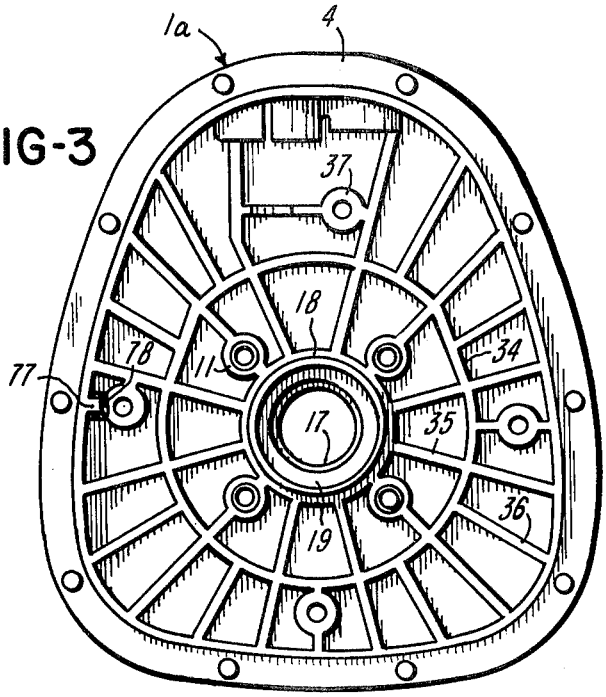
FIG. 3 is a view of the half of the pump housing of which positions adjacent its prime mover.

As seen in FIGS. 1 and 6, the oblique innermost extremity of the tubular wall segment 63 which opens to entrance chamber 67 is normally capped by a molded one-piece valve member 72 formed of rubber or elastomeric material. The member 72 is comprised of a main body or flapper portion 73 having a thickness to assure stiffness, a limited peripheral edge portion of which is extended somewhat by a relatively thinner portion 74 having in connection therewith a tab portion 75. The portion 75 is fixed, in the molding of the member 72, in a position to be angularly related to the flapper portion 73. Formed in the body of the housing half **1*b*, between most closely related side portions of the tubular wall segments 63 and 65 is a socket 76 in which the tab portion 75 is wedged and attached to facing portions of said segments by adhesive. The angular relation of the tab 75 to the flapper portion 73 provides that in the anchoring of the tab portion in its socket it extends generally perpendicular to the base 62 while the flapper portion 73 is naturally angled to seat in biased capping relation to the inner end of the wall segment 63. The portion 74 provides a permanent hinge enabling the ready displacement of the flapper element to and from the wall segment 63** in operation of the pump.

In use of the pump free rotation of the volute assembly of the pump is prevented by the engagement of a lug 77 in the notch 43 formed in the peripheral edge of the plate 39. The lug 77 is capped by a resilient layer or coating of rubber or elastomeric material defining thereon the sleeve 78 forming a resilient shock absorbing interconnection between the lug 77 and the volute assembly since the lug 77 is formed integral with and projects inwardly from the inner surface of a peripheral wall portion of the housing half **1*a***.

Nothing FIG. 1 of the illustrated embodiment of the invention, each of the wall segments of the housing half **1*b*** which define the inlet and outlet portion of the pump are internally threaded to facilitate the coupling to the pump of suitable lines or conduits, through one of which may be drawn liquids and solids to be evacuated from a particular location and through the other of which may be delivered the same liquids and solids to such areas or means as may be desired in accordance with the service to which this particular pump is applied.

Once suitably primed, the pump may be maintained in operating condition by a continued energizing of its prime mover, whereupon rotation is continuously imparted to the impeller unit 49 by way of its connection to the drive shaft 20. Since the shroud plate and vanes of the impeller as related to the resilient material of the part 58 cap the opening 68 which forms the only entrance to the impeller, the operation of the impeller and its vanes will produce a suction effect reflected in the chamber 67 to induce the flapper portion 73 of the valve element 72 to move inwardly of the chamber 67, whereupon liquids and solids in the area with which the pump inlet 61 is communicated will be drawn to and through the inlet and by way of the chamber 67 and opening 68 into the eye of the impeller bounded by its vanes 51. Particular attention is directed to the fact that with the eccentric orientation of the wall structure 63 with reference to the wall segment 65 and the angular position of the valve flapper portion 73, as materials are drawn inwardly of the chamber 67 the flapper 73 will angle to insure the direction thereof towards the eye of the impeller. In the operation of the impeller the materials drawn thereto will be discharged by the vanes thereof and into the spiral passage of the volute portion 44 to be moved in an accelerated flow and discharged to the chamber 69 and from the chamber 69 and the pump by way of the pump outlet 70. Particular attention is also directed to the fact that on the pressure side of the impeller the chamber 69 includes the area in the pump housing external to the wall segment 65, the volute assembly 40 and the wall segment 18, within which the operating elements of the pump are fully protected and sealed. The pressure developed in the discharge of materials from the pump will be communicated, therefore, with the flexible resilient tube 28 which contains a supply of lubricating oil in direct communication with the annular chamber 26 between the seal elements 23 and 24. This arrangement insures that the pump operation produces a self-lubrication of its seals. As liquids and solids move into and fill the chamber 69 and exit by way of the outlet 70 the pressure on the flow thereof will be communicated to the tube 28 which will be induced thereby to inherently expel lubricating fluid into the annular chamber 26 under a pressure the level of which corresponds to the pressure developed in the material being discharged under the influence of the operation of the impeller unit 49. This lubricating oil will exert pressure on the adjacent opposite faces of the seals 23 and 24, producing an expansion of the seal element 23 to cause it to seal firmly to and about the shaft 20 at the point where it enters the pump base 2 and to establish a pressure block in the chamber 26 in backing relation to the flange 25. Since the shroud plate and vanes of the impeller unit 49 are contained between the resilient elements 58 and 60 and the latter has its inner periphery bearing on and peripheral to the inwardly projected extremity of the wall segment 18, the passage of the materials on which the pump impeller operates to the rear of the impeller and in and about its hub is inhibited. Thus on the inner side of the flange 25 the pressure will be substantially less than that in the chamber 26 during the operation of the pump. This being the case, the lubricating system provided in accordance with the invention enables full protection of the pump seals, thereby giving the pump and its parts a greatly extended operating life as contrasted to similar pumps of the prior art.

Not only does the close running clearance as between the impeller and the resilient facing elements 58 and 60 reduce substantially the pressure in the area about the impeller hub but the arrangement is productive of a high efficiency of the pump and without damage to the impeller and volute assembly. It is to be kept in mind that the impeller has a resilient coating and such resilient material is in sufficiently closely adjacent relation with the resilient elements 58 and 60 to provide for an effective pumping action on the part of the impeller 49. This means the full impeller effect is given to the production of suction and to a positive discharge of the materials received in the eye of the impeller under the influence of the developed suction.

The volute assembly is resiliently balanced in respect to the shroud plate and vanes of the impeller, which have a resilient coating, by reason of the elements 58 and 60, and the latter in turn resiliently contain the impeller. Thus, when sand, gravel or like particles attempt to pass between the impeller and the volute they will either be inhibited from passage or momentarily imbedded in the resilient material of the elements 58 and 60. As a vane passes these momentarily imbedded particles, they will pop out again from the resilient material and eventually pass to the discharge chamber 69 without significant or material damage to the parts. The invention arrangement thus precludes the solids from chewing up the impeller and the volute structure, so often an early incident of the operation of conventional pumps applied to similar purposes. In accordance with this feature of the invention, not only are maintenance problems reduced but the life of the impeller and volute structure is extended many, many times.

In the simply fabricated pump here provided the entire volute assembly would be free to turn on its mounting shoulder except for the fact that the lug 77 capped by the resilient sleeve 78 projects within the notch 43 in the volute plate 39. Not only is the volute assembly held in a proper position by the arrangement thus provided but the resilient sleeve 78 provides a shock absorber accommodating relative movement of and preventing damage to the volute and the plates which contain the volute 44 when in the operation of the pump these elements are subjected to shock in handling stones which seek to move between the impeller and the sealing elements 58 and 60 or between the impeller and the cut water tip 47. The latter serves a similar function as well as to protect a vulnerable portion of the volute.

One further feature of the invention construction is the seal provided by the gasket 66. As constructed this gasket has a built-in warpage flange, including not only a portion peripheral to the inner projected extremity of the wall segment 65 in the housing half **1*b* and a portion overlapping the projected extremity thereof but also a radial portion configured and interrelated with plate 57 such that should the pump expand or breathe due to extremely high pressure developed in the pump, the gasket and the various parts thereof will stay close to the elements to which they relate and maintain a seal between the gasket and the volute plate and the wall segment 65 which prevents internal leakage between the outlet portion or discharge chamber of the pump and the inlet portion defined by the chamber 67**.

Of course, the one-piece molded structure of the check valve 72 and the mount thereof is of the simplest nature as is the volute assembly wherein the plates 39 and 57 are fabricated so as to be identical as to their basic configuration.

The chamber 69 may be drained through an opening in a lower part of the pump housing, normally closed by a plug 77. When one considers together with the foregoing the simple interrelation of the parts and the assembly thereof which provides that as the housing half **1*b* is clamped to the housing half 1*a*** that the internal operating parts are fixed in their respectively required positions, it becomes readily apparent that there has been achieved by the present invention a pump which is not only one which will have extended operating life but one which is more economical to fabricate, assemble and to operate than conventional pumps heretofore provided for similar applications.

Figure 7:
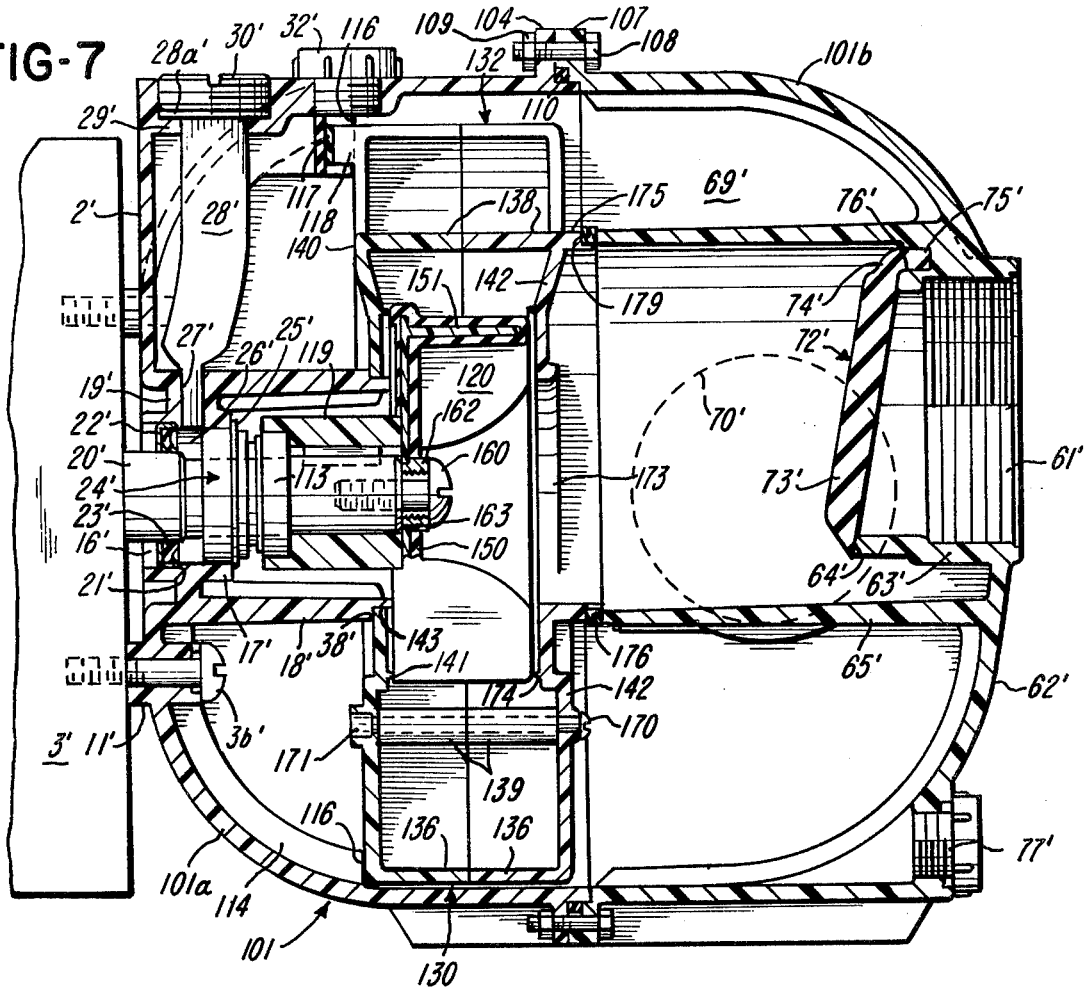
FIG. 7 is a cross sectional view of a centrifugal pump constituting a preferred embodiment of the present invention, the nature of the view being similar to that illustrated in FIG. 1, and the view being taken substantially along the line 7—7 of FIG. 9.

FIG. 7 shows a cross sectional view of a preferred embodiment of the present invention wherein many of the parts are similar to those included in the first described embodiment. Such similar parts are designated with like numerals but distinguished in the preferred embodiment by a prime (') symbol.

Noting FIG. 7, the preferred embodiment there illustrated includes a housing 101 comprised of a pair of cup-shaped parts 101*a* and 101*b*. The lips of these parts include flanges 104 and 107 formed and shaped like the flanges 4 and 7 and arranged to interfit and be clamped together by the application of bolts 108 and nuts 109 in a manner and by means such as set forth with reference to the embodiment first described. An O-ring 110 is interposed to form a liquid tight seal of the joint provided between the flanges 104 and 107 as they are clamped together.

The parts 101*a* and 101*b* are distinguished from the parts 1*a* and 1*b* by the fact that their peripheral wall portions are generally circular in cross section. Formed integral with the base of 2' the part 101*a*, each in rimming relation to an aperture therein, is a series of tubular bosses 11'.

As in the case of the base 2, the base 2' is provided with a passage 16' defined by a short tubular wall segment 17' held within and in concentric spaced relation to the outermost end portion of a relatively longer tubular wall segment 18' by a circumferentially extending integrally connected radial web 19'. The segments 17' and 18' extend inwardly of the housing half 101*a* in a sense perpendicular to the base 2' while the outermost end of the segment 18' merges with the base 2' and together with the web 19' and the interconnected segment 17' forms an extension thereof. The innermost surface of the wall segment 18' is provided with a series of longitudinally extending ribs the projected depth of which closely approximates the depth of the web 19'. These ribs extend from the web 19' to points adjacent but spaced from the inwardly projected extremity of the wall segment 18'.

In coupling the pump constituting this preferred embodiment of the present invention to its prime mover, the housing part 101*a* is first applied to seat the outwardly projected ends of the bosses 11' in respective alignment with and in rimming relation to internally threaded bores formed in the wall of the prime mover housing 3'. In the process the passage 16' accommodates the projection therethrough of the prime mover drive shaft 20'. The part 101*a* is then secured to the prime mover housing 3' using screws 115 in a manner believed obvious from FIG. 7 of the drawings. The screws are so applied to extend through the bosses 11' and have the heads thereof abut the innermost ends of the bosses while their projected extremities are threadedly engaged in the aligned bores and thereby firmly secured to the prime mover housing 3'.

The outermost end of the inner wall surface of the segment 17' has a counterbore forming an outwardly facing shoulder 21'. Positioned in the outermost end of the passage 16' and seated on the shoulder 21' is a two-part ring seal. This seal includes a relatively rigid centrally apertured cap-shaped element 22'. The latter is fixed within the wall segment 17' with its outer peripheral wall surface in engagement therewith, its base outermost and the lip thereof in seated relation to the outer peripheral edge of the shoulder 21'. Nested within the cap element 22', and facing inwardly of the passage 16', is a resilient, flexible ring-shaped sealing element 23'. The configuration and dimension of the element 23' is such that in the application thereof its inner surface is caused to be cupped, thereby causing its outer peripheral edge to bear against the peripheral wall of the element 22' and its inner peripheral edge against, about and in sealing relation to the shaft 20', which is passed therethrough as it extends interiorly of the pump housing part 101*a*. By reason of the nature of the cupping of the seal element 23', any pressure applied from the interior of the pump housing will cause it to expand and to more firmly grip in a sealing relation to and about the shaft 20', as well as to the peripheral wall of the element 22' in which it nests.

When the housing half 101*a* is properly secured to the housing 3', the shaft 20' will project inwardly of the housing part 101*a* to a plane which is somewhat beyond but adjacent to that occupied by the inwardly projected extremity of the wall segment 18'. First applied over the end of the shaft 20' which is innermost with reference to the housing 101, to partially nest in the tubular wall segment 17', is a bearing-type seal assembly 24' intermediate the axial length of which is a radially projected flange 25'. The extent to which the seal 24' nests is determined by the overlapping abutment of the flange 25' with the inwardly projected extremity of the wall segment 17'. The arrangement is such to establish the seal assembly 24' in end spaced relation to the seal 23', thereby to produce therebetween an annular chamber 26'. Opening to the chamber 26' is one end of a generally radial aperture 27' formed in and extending through the wall segment 18', the web 19' and the wall segment 17'. Secured in the end of the aperture 27' remote from the chamber 26', to its rimming wall structure, is an open end of a flexible tube-like element 28', the opposite end of which passes through an aligned opening provided in a recessed flatted wall segment 29' formed in a peripheral wall portion of the housing part 101*a*. The open end of the tubular element 28' remote from the chamber 26' has an external flange 28*a'* positioning exterior to the housing and seated in abutting relation to the outer surface of the recessed wall portion 29'. As shown, the flange 28*a'* is positioned at the top of the pump in the orientation illustrated and rims the inlet to the tube 28', which in use of the pump is filled with lubricating oil. The flatted wall portion 28' is rimmed by a perpendicularly projected internally threaded wall portion threadedly engaged by a cylindrical plug element 30'. The latter, as will be seen from the drawings, serves to clamp the flange 28*a'* to the wall portion 29', thereby to normally cap and seal the inlet opening to the tube 28', whereupon the only opening from the tube 28' is to the annular chamber 26'. Adjacent to the flatted wall portion 29' the peripheral wall of the housing half 101*a* has a further aperture providing a filler port for applying priming liquid to the interior of the pump as and when required. This latter aperture is normally capped by a plug 32', shown to be threadedly engaged to the wall structure which defines this aperture.

Figure 10:
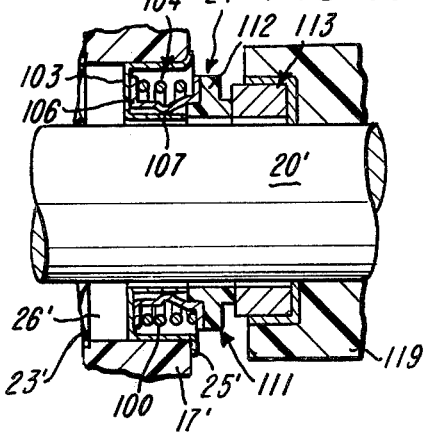
FIG. 10 is a fragmentary sectional view illustrating the details of the bearing seal provided about the drive shaft of the pump impeller as illustrated in FIG. 7.

In this preferred embodiment of the invention the seal assembly 24' is comprised, basically, of two portions, one of which is fixed to the wall segment 17' and the other of which is fixed in the hub of the impeller 120 connected to the shaft 20'. The portion of the seal assembly 24′ in connection with the tubular wall segment 17′ includes a ring-shaped seal element 103 which is axially extended and U-shaped in cross section. This element 103 is fixed to position between the inner wall surface of the tube segment 17′ and the shaft 20′ with the closed end thereof being positioned most adjacent the seal 23′, to define therewith the annular chamber 26′. The lip of the outermost wall section of the element 103 is formed to include thereon the external flange 25′, which as previously described overlaps the inner projected extremity of the wall segment 17′ and thereby determines the position of the seal assembly 24′ and the element 103 thereof. Nested interiorly of the element 103, to have one end thereof seat to its base and the other end project outwardly therefrom to a slight degree, is a cylindrically configured tubular spring unit 104. The unit 104 is comprised of an inner axially compressible generally tubular sleeve 106 externally flanged to each of its opposite ends and having intermediate the length thereof an offset portion 107 arranged to bear on and about the radially innermost wall section of the element 103. Coiled about the sleeve 106 to extend between and in abutting relation to its end flanges is a spring 100. By virtue of the shape of the sleeve 106, the flanged end thereof which is innermost of the housing part 101*a* and projects slightly beyond the plane occupied by the flange 25′ defines, with the shaft 20′, an annular cup-like cavity. In this latter cavity is secured one end of an axially extended carbongraphite self-lubricating sealing ring 111. The ring 111 has a radial flange 112 intermediate its axial limits which projects to overlie and to fix in abutment with the adjacent flange at the innermost end of the sleeve 106. Completing the seal assembly 24′ is a ceramic ring 113 which, as will be seen, is fixed in connection with the impeller hub and for rotation therewith in correspondence with the rotation of the shaft 20′. As may be seen in FIG. 10 of the drawings, there will be a bearing end abutting relation as between the adjacent seal parts 111 and 113.

As in the case of the first described embodiment the halves of the housing 101 are formed of high impact strength plastic and the interior surface of each thereof is molded to include a series of relatively projected ribs 114. As seen in FIG. 7, the ribs which are integral with the inner surface of the housing half 101*a* radiate from the outer end of the tubular wall segment 18′, across the base 2′ and extend upwardly of the side wall portion of the housing half 101*a* to a plane which is parallel to the inwardly projected end of the wall segment 18′ and short thereof. The projected ends of the ribs 114 form thereby a series of co-planar shoulders 116 which are spaced in a circumferential sense. The details of the ribs are not otherwise important and therefore not further described. The ribs may be arranged in any suitable spacing or fashion to serve additionally as reinforcements for the body of the pump housing. The ribs are designed to facilitate the formation of the housing halves 101*a* and 101*b* as thin walled structures.

This embodiment of the invention utilizes a volute assembly of an improved nature which is a two-part unit. It includes a double volute structure wherein the volutes 136, 138 are split in a plane which is centered intermediate their axial limits and the respective halves thereof are made integral with and perpendicular to a base plate portion 140, 142. The base plate portions 140, 142 respectively provide a rear 140 and a front plate portion 142 of the volute assembly here provided. The base plate portions have identical configurations such that each effectively includes two plate sections of somewhat semicircular outline integrated in co-planar relation so that their diametral edges angularly overlap to a slight degree and are merged with their centers offset. The respective half sections of the two volutes 136, 138 are integrated and extend coextensively with and perpendicular to the arcuate peripheral edge portions of the base plate portions to which they connect. Since the longitudinal extent of the spiral form of each volute half section is about 180° in the one case (138) and greater than 180° in the other (136), this gives the volute half sections an arrangement wherein they are in respectively overlapping spaced relation at the ends thereof which position radially innermost of the base plate portion to which they connect. The volute half sections 136, 138 not only define volute shaped flow paths but peripheral outer wall portions of the two-part volute-housing assembly here disclosed. As will be seen, in completing the assembly of the volute structures, the two parts of the assembly 130, 132 which are similarly formed, are superposed to align, in an axial sense, the respective half sections of the volute strips 136, 138 which they embody. In the process the volute housing thereby formed will exhibit openings 144 and 146 at respectively opposite side portions thereof. The parts 130, 132 will be molded, preferably, of high impact strength plastic. Slipped over the radially innermost end of the volute sections 136 is a aerodynamically shaped cut water tip element 47′. This element is similar to the element 47 previously described except that axially thereof it has a bore 137. The radially innermost end of each volute section 138 is extended by an adhesively and co-extensively attached molded rubber part 139 having a similar bore 137 axially thereof. The purpose of the bores 137 will be further described.

The innermost extremity of the tube segment 18′ is reduced in external diameter to form on its outer surface an annular shoulder 38′ which faces inwardly of the housing half 101*a*. The central portion of the base plate 140 of the part 130, within the area bounded by its integrated volute strip portions 136 and 138, is dished. Central to this dished portion of the base plate 140 is an aperture 143. The latter is so dimensioned to provide for a slip fit therethrough of the reduced inner end portion of the tube segment 18′ as the part 130 is assembled as required. The arrangement is such to provide that the volute half sections also project inwardly of the part 101*a* as the rearmost surface portion of the base plate 140, immediately about its aperture 143, seats to the shoulder 38′. At the same time, diametrally opposite peripheral portions of the rear surface of the plate 140 seat to and are backed by shoulders 116 provided by a pair of generally diametrically spaced ribs 114. One of these diametrically spaced ribs 114 is widened at its shoulder portion 116 and has formed therein a notch 117. In the placement of the part 130 on the tube segment 18′ and against the shoulders 116, a lug 118 integral with and projected from the rearmost surface of the base plate portion 140 is caused to be disposed in the notch in the widened shoulder 116. Lining such notch are layers of resilient material which resiliently accommodate slight movements of the lug 118, and thereby of the part 130, in a rotative sense. By such means, as the part 130 is restrained from rotational movement of the reduced end portion of the tube segment 18′, the restraint is achieved, in a shock absorbing fashion.

Once the part 130 is applied in the housing half 101*a* as described, a sleeve element 119 is slipped over and keyed to the inner end of the drive shaft 20' to nest within the area bounded by the inner wall of the segment 18' and in spaced relation thereto. As will be seen, the sleeve element forms the hub of the impeller 120. The end of the sleeve 119 most adjacent the base 2' is counterbored to have suitably fixed therein the ceramic ring 113 which engages the carbon graphite ring 111 and forms the rotating part of the seal assembly 24'. The dimension and positioning of the sleeve 119 is such that its innermost end and the projected extremity of the shaft 20' are co-planar.

Once the part 130 is mounted as described, it is secured in place by application of the impeller 120 which is connected to the shaft 20'. The impeller 120 is comprised of a centrally apertured shroud plate 150 having a pair of integrally connected perpendicularly projected impeller vanes 151. As in the case of the shroud plate 50 and the vanes 51, these items are provided with a coating of rubber or elastomeric material. The central aperture in the shroud plate 150 is provided with a diameter which is less than the diameter of the inwardly projected end surface of the drive shaft 20'. In view of this fact, when the impeller 120 is positioned coaxially with the shaft 20' and its central aperture is centered on the end surface of the shaft 20', the shroud plate will have its rear surface portion, about its central aperture, bear thereon. At the same time the rear outer peripheral edge portion of the coated shroud plate will position over and in adjacent, very closely spaced relation to the inwardly projected extremity of an annular rib 141 formed on the adjacent inner surface of the plate portion 140. When so positioned, the shroud plate 150 is fixed to the shaft 20'. To this end there is first applied a sleeve 162. The sleeve 162 has a tubular form and the inner wall thereof is threaded while its outer wall is reduced in diameter to one end to form thereon a shoulder 163. In the application thereof the reduced end portion of the sleeve 162 is inserted in the central opening in shroud plate 150 to abut the end portion of the shaft 20' which is rimmed by the inner edge of the shroud plate 150. This establishes the shoulder 163 in overlapping abutted relation to the innermost surface portion of the shroud plate, immediately about its central aperture. Once the sleeve 162 is so positioned, the body of a headed screw 160 is thrust therethrough and threadedly engaged in a threaded bore provided in and opening from the end face of the shaft 20' which is surrounded by the abutted end of the sleeve 162. By such means the impeller 120 is fixed to its hub 119 and in a driven relation to the shaft 20'.

Particular attention is directed to the fact that the internal diameter of the sleeve 162 is greater than the diameter of the body of the screw 160. If there should be difficulty in removing the impeller and the sleeve 162 upon removal of the screw 160 at a later date, one may apply a larger diameter screw in its place the threads of which are complementary to the threads of the sleeve 162. Upon screwing this larger diameter screw into the sleeve to have its projected extremity abut the end face of the shaft 20' and then continuing to turn this screw one may jack the sleeve off of the shaft 20' and thereby effect a ready release of the impeller.

Once the impeller is fixed to its hub the second part 132 of the volute-housing structure is then applied over the part 130, to place the respective half sections of the volute strips 136 and 138 in a direct axial alignment and in end abutting relation. This completes the double volute structure and creates a volute housing peripheral wall portions of which are provided by the volute segments themselves. The simplicity and advantage of the fabrication of the volute-housing structure in this manner is believed self-evident. As the parts 130 and 132 are brought together, the half portions of the elements 47' and 139 are also aligned, to have the bores 137 thereof define through passages accommodating in each case the body of a bolt 170 the head of which, as shown, abuts the outermost surface of the base plate portion 142 while its threaded extremity is engaged by a nut 171, at a location exterior to the opposite base plate portion 140.

The molded two-part structure forming the volutes and their housing, unitized by bolts 170 and nuts 171 in a very simple fashion, is held in position in an axial sense by the fixing of the impeller 120 to the drive shaft 20' as previously described. The arrangement is such that the rotation of the impeller could well cause a tendency of the volute-housing structure to rotate also. However, any tendency in this respect is resiliently restrained by the engagement of the lug 118 in the notch 117.

A central area of the plate portion 142 of the part 132 is also dished inwardly of the composite structure 130-132, in the area thereof facing the outer projected extremities of the impeller blades 151. Formed on the inner surface of the plate portion 142 is an annular rib-like projection 174 which is adjacent and slightly spaced from the outermost tips of the impeller blades 151 and defines therewith the inlet side of the impeller. A central aperture 173 in the plate portion 142 defines the inlet to the eye of the impeller 120 and is surrounded at the outer surface of the base plate portion 142 by an eccentrically positioned, generally tubular, integrally formed projection 175.

The base portion 62' of front half **101*b* of the housing 101 includes an inlet aperture 61' which is offset from a direct alignment with the inlet 173 which opens to the eye of the impeller. Formed integral with the inner surface of the base 62', to rim the aperture 61' and project inwardly thereof, in a sense perpendicular thereto, is a tubular wall structure 63' the inwardly projected end portion 64' of which is obliquely angled. Also formed integral with the base 62' and projected inwardly thereof and perpendicular thereto, in surrounding spaced relation to the wall structure 63', is a further generally tubular wall segment 65'. The construction and arrangement of the parts 63' and 65' are the same as that of the elements 63 and 65 first described. Moreover, the oblique inner end 64' of the tubular wall segment 63' is capped by a one-piece valve member 72' the configuration and installation of which is identical to that illustrated with reference to member 72** in the embodiment previously described.

In applying the housing half **101*b* the projected extremity of the tubular wall segment 65' is placed in substantial alignment with the projection 175. The projected extremity of the latter is reduced in external diameter to form thereon an annular shoulder 179 which faces the adjacent end of the projection 65', in closely spaced relation thereto. A ring type elastomeric seal 176 which is U-shaped in cross section is positioned on its side to fill the gap between the shoulder 179 and the adjacent end of the wall segment 65'. The disposition of the seal 176 provides that the open end thereof is peripheral to and directed radially and outwardly of the reduced end of the projection 175. The arrangement and nature of the seal 176 is such as to accommodate slight breathing and displacement of the adjacent parts while preventing the breaking of a seal which it provides to separate the inlet chamber 67' defined within the bounds of the tubular projection 65' from the discharge chamber 69' which is exterior thereto and to the two-part volute-housing structure 130, 132**.

In this preferred embodiment the pump discharge opening 70' is located in the side wall of the housing part **101*b*, considering the orientation of the pump as shown in FIG. 7, intermediate its vertical limits. The pump drain hole is located in the base 62' to one side of and remote from the discharge opening 70'. This drain hole is capped by a plug 77'**.

Figure 8:
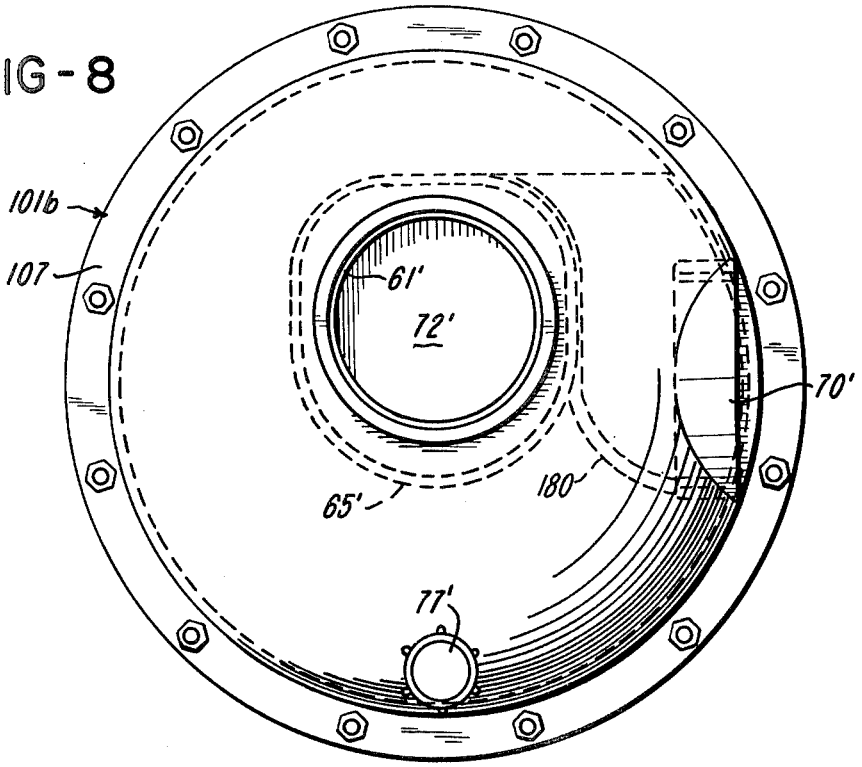
FIG. 8 is an end view of the pump of FIG. 7.
Figure 9:
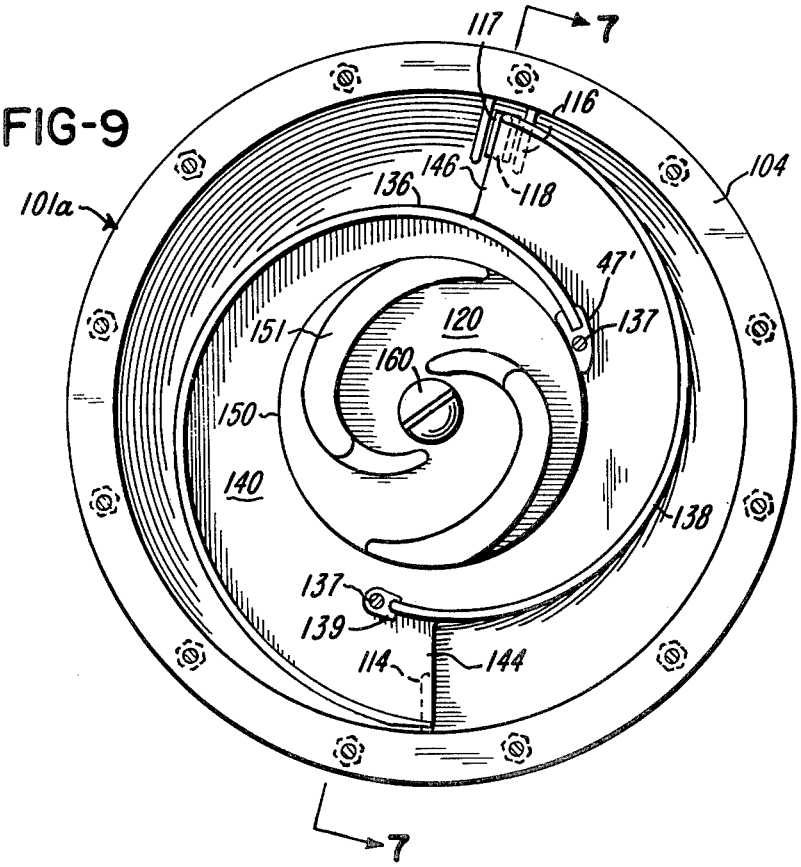
FIG. 9 is a view looking into a rear half of the pump housing, a front portion of the double volute assembly being omitted.

Attention is directed to FIG. 8 of the drawings wherein a baffle 180 is illustrated to extend across the discharge chamber 69', from the side of the tubular wall segment 65', in an arcuate fashion, to a point on the outer peripheral wall of the housing part **101*b* which is just below the discharge outlet 70'. As seen from FIG. 8, with the orientation of the pump as illustrated, the baffle 180 insures that, once water is introduced, the discharge chamber of the pump housing will stay full of water to the level of the inlet 61'**.

The outlet 70' is shown at a 3 o'clock position rather than at the top of the pump as in the embodiment first illustrated. This saves the requirement for a 90° elbow and places the pump discharge closer to the ground, thus reducing the danger of an undesirable bend in the discharge hose which is utilized in connection with the pump.

The embodiment of the invention shown in FIGS. 7 through 10 will function similarly to the first described embodiment, but in the function thereof it will have the benefit of the various differences in structure here disclosed. In this latter respect, attention is particularly directed to the details of the seal which are specifically illustrated in FIG. 10. As shown, there is slight spacing between the inner periphery of the elements comprised in the seal part 24' and the shaft 20' which projects therethrough. This permits a slight amount of lubricant to pass to and to gradually move outward between the adjacent faces of the seal elements 111 and 113 under the differential pressure conditions which exist as between the chamber 26' and the space surrounding hub 119 as previously described. The movement of the lubricant between the elements 111 and 113 will be slow, molecule by molecule and not only provide additional lubrication between these surfaces but flushing away of any dirt that tries to move outwardly along the shaft 20'.

In the embodiment of FIGS. 7–10, the volute housing structure has a limited movement in an axial sense and is damped as to rotational movement so it floats, to a limited degree, with attendant benefits as in the case of the first described embodiment.

Considerable benefits also obtain, from the standpoint of economy and precision of fabrication, in the formation of this volute-housing structure of two plastic parts.

Attention is also directed to the cut-water structures 47' and 139 in connection with the double volute arrangement. Their design not only facilitates the connection of the volute-housing parts 130 and 132 but they provide functional advantages as in the case first described. That of the cut-water 47' is the same as in the case of the cut-water 47. The cut-water extension 139 serves likewise in protection of the volute 138 and by its spacing from the periphery of the impeller as illustrated, when the impeller becomes airbound allows water to get into the impeller and the volute chamber and achieve a priming action in a manner believed obvious.

Of course, in the operation of the pump of FIGS. 7–10 the supply of lubricant in the element 28' is maintained under pressure, under the influence of the materials being discharged, in a fashion identical to that previously described with reference to the element 28.

In any case, the invention provides simplicity and economy of fabrication and maintenance and ease of assembly and disassembly while exhibiting the functional features herein described.

In the case of the preferred embodiment of the invention, one can adhere annular rubber or elastomeric elements, similar to the elements 60 and 58 previously described, to the inner surfaces of the plate portions 140 and 142 respectively to rim the inner projected reduced extremity of the tubular wall segment 18' and the inlet aperture 73 within the bounds, respectively, of the annular ribs 141 and 174.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A pump particularly advantageous for use in evacuating liquids and solids from a given location, comprising a housing having an inlet thereto and an outlet therefrom, an impeller within said housing, said housing having an opening accommodating the projection therein of a drive shaft arranged to mount said impeller interiorly of said housing, means defining a flow passage through said housing one end of which includes said inlet and the other said outlet, said impeller being positioned within and intermediately of the ends of said flow passage, a volute shaped structure contained between plate-like elements which form therewith a part of said flow passage, said volute shaped structure being positioned about and in encompassing relation to a peripheral portion of said impeller which is contained between said plate-like elements, said volute structure having a spiral configuration which opens to an exit chamber defined in said housing, a wall segment of which exit chamber includes said housing outlet, one of said plate-like elements having an opening therein which is in direct communication with said housing inlet, said impeller embodying vanes positioning peripherally about said plate opening whereby on drive of said impeller to induce an inflow of liquids and solids to said impeller by way of said housing inlet, the said vanes of said impeller being positioned to be operative to direct materials received thereby in a sense peripherally thereof, under pressure, to exit, by way of said volute structure, to said exit chamber, the means defining said opening accommodating said drive shaft also accommodating sealing means which position about said drive shaft, means being provided within said exit chamber to store a supply of lubricant and to place the same in open communication with said drive shaft and the sealing means thereabout, said lubricant storing means including a peripheral wall a portion of which is resilient and flexible and exposed to the flow of liquids and/or solids moved to and through said exit chamber and from said housing by way of said outlet, the pressure applied to move said liquids and/or solids being thereby applied directly to said resilient flexible portion of said lubricant storing means whereby to produce an automatic lubrication of said shaft and the sealing means embodied in association therewith.

2. A pump as in claim 1 wherein said sealing means is a two unit sealing means arranged in said housing opening accommodating said shaft to form about said shaft therein an annular chamber through which lubricant has access to said shaft, and means placing said lubricant storing means in communication with said annular chamber.

3. A pump particularly advantageous for use in evacuating liquids and solids from a given location comprising a housing having an inlet thereto and an outlet therefrom, an impeller within said housing, said housing having an opening accommodating the projection therein of a drive shaft arranged to mount said impeller interiorly of said housing, means defining a flow passage through said housing one end of which includes said inlet and the other said outlet, said impeller being positioned within and intermediately of the ends of said flow passage, a pair of seals being applied about said drive shaft within the means defining said housing opening accommodating the projection therein of said shaft, said seals being positioned in end spaced relation to define therebetween and with said means defining said opening accommodating said drive shaft an annular chamber, said means defining said opening accommodating said drive shaft including a passage therethrough opening to said annular chamber, in which passage is fixed an open end of a resilient flexible tube-like structure containing a supply of lubricant the opposite end of which is anchored to said housing, said tube-like structure being located in said flow passage immediately upstream of said outlet, said tube-like structure being exposed to and operated on by the flow through said passage applying direct pressure thereto under the influence of the operation of said impeller whereby to insure that said annular chamber is continuously and automatically provided with a supply of lubricant under a pressure to maintain the operative sealing quality of said seals which are positioned about said drive shaft.

4. A pump comprising a housing having an inlet thereto and an outlet therefrom, means defining a flow passage extending between and interconnecting said inlet with said outlet, an impeller at least a portion of which is positioned within and in bridging relation to a portion of said flow passage, a prime mover including a drive shaft, said housing having a passage accommodating the projection therein of said drive shaft, said impeller being mounted in connection with the inwardly projected end of said drive shaft, a pair of seals positioned about said drive shaft to bridge the space between said drive shaft and the means defining said passage accommodating said drive shaft, said seals being in end spaced relation and defining therebetween about said drive shaft and with the means defining the passage accommodating said drive shaft a lubricant receiving chamber, means providing a supply of lubricant interiorly of said housing, means utilizing pressure generated by operation of said impeller to direct a movement of lubricant from said supply thereof through a portion of said housing defining said passage accommodating the projection therein of said drive shaft to said lubricant receiving chamber under a pressure to maintain the operative sealing quality of said seals, said means providing a supply of lubricant including a flexible tube-like portion containing a supply of lubricant, said flexible tube-like portion being located in said flow passage immediately upstream of said outlet and being resilient and free and arranged to flex and be compressed and to respond to and be operated on by the flow through said passage applying direct pressure thereto under the influence of the operation of said impeller in correspondence with which said flexible tube will be flexed to induce a transfer of lubricant as between the tube and said lubricant chamber.

5. A pump comprising a housing having an inlet thereto and an outlet therefrom, means defining a flow passage extending between and interconnecting said inlet with said outlet, an impeller at least a portion of which is positioned within and in bridging relation to a portion of said flow passage, a prime mover including a drive shaft, said housing having a passage accommodating the projection therein of said drive shaft, said impeller being mounted in connection with the inwardly projected end of said drive shaft, a pair of seals positioned about said drive shaft to bridge the space between said drive shaft and the means defining said passage accommodating said drive shaft, said seals being in end spaced relation and defining therebetween about said drive shaft and with the means defining the passage accommodating said drive shaft a lubricant receiving chamber, means providing a supply of lubricant interiorly of said housing, means utilizing pressure generated by operation of said impeller to direct a movement of lubricant from said supply thereof through a portion of said housing defining said passage accommodating the projection therein of said drive shaft to said lubricant receiving chamber under a pressure to maintain the operative sealing quality of said seals, said means defining said passage accommodating the projection therein of said drive shaft being defined by a tubular wall structure having means restricting said passage at the entrance thereto, said seals being accommodated, at least in part, in said passage restricting means, to define therewith said lubricant chamber, said means providing a supply of lubricant for said lubricant chamber including a flexible resilient tube one end of which is positioned to open through said tubular wall structure to the interior of said lubricant chamber, said impeller including a shroud plate having its rear surface and means defining a resilient surface in backing relation thereto arranged to be closely spaced so as to, in rotation of said impeller, inhibit passage therebetween of solids, said tubular wall structure accommodating said drive shaft having the inner end thereof capped by the rear surface of said shroud plate and the means defining a resilient surface in backing relation thereto and together therewith and with the innermost of said seals defining a chamber about said shaft, the rotation of said impeller producing a condition providing that the pressure existing on the innermost of said seals at the side thereof remote from said lubricant chamber will in the operation of the pump be less than the pressure developed interiorly of said pump housing by a pressured flow to and from said housing of materials drawn to and delivered from said pump under the influence of the rotation of said impeller.

6. A pump as in claim 5 wherein the outermost one of said seals with respect to the interior of said housing includes a flexible seal element which has a cup-like configuration in the portion thereof which immediately bounds the outermost end of said lubricant chamber, said flexible seal element having means defining a rigid backing therefore and functioning on the introduction of lubricant to said lubricant chamber, under pressure, to firmly seal to and about said shaft in the operation of said pump and thereby preclude the passage of lubricant to the exterior of said housing.

7. A pump as in claim 6 wherein the innermost of said seals includes one portion fixed in connection with the means defining the passage accommodating said drive shaft and another portion fixed for rotation with said drive shaft by application thereof in connection with means defining a hub for said impeller.

8. A pump as in claim 7 wherein said one portion of the innermost of said seals includes a ring-shaped element which is U-shaped in cross section, the base of which defines one wall portion of said lubricant chamber, said ring element nesting an axially compressible spring means which projects outwardly from the open end thereof to a slight degree and defines at its outwardly projected extremity a seat for a graphite-carbon seal ring which is connected therewith to be placed under the influence thereof in end abutting relation to a ceramic ring which provides said seal portion in connection with the hub of said impeller.

9. A pump comprising a housing having an inlet thereto and an outlet therefrom, said housing including a pair of cup-shaped parts the lips of which are placed in connected relation to form said housing, one of said cup-shaped parts being adapted for connection to a prime mover and including in the base thereof an opening for the projection therethrough of a drive shaft of said prime mover as said one housing part is coupled to said prime mover, said opening for said drive shaft being defined by a tubular wall structure which projects inwardly of and generally perpendicular to said base, a first generally annular plate-like structure positioned in abutment with a portion of the inwardly projected extremity of said tubular wall structure to have the position of said annular plate-like structure defined thereby, an impeller releasably coupled to said drive shaft, said impeller including a shroud plate extending in overlapping relation to the inner peripheral portion of said annular plate and in capping relation to the inner projected extremity of said tubular wall structure, said impeller having a plurality of vanes projected from and generally perpendicular to the surface thereof which is remote from said annular plate-like structure, a second generally annular plate-like structure positioning in a capping relation to the projected extremities of the vanes of said impeller, volute structure positioned between and laterally confined by said generally annular plate-like structures, said volute structure being in peripherally encompassing relation to said impeller and forming at least one generally spiral passage open to the discharge side of said impeller having its discharge end in communication with said housing outlet, the central opening in the second of said annular plates defining an inlet to said impeller, the other said cup-shaped part of said housing including in a base portion thereof said housing inlet, means in connection with said base portion of said second cup-shaped part of said housing defining a tubular wall segment the outermost end of which is positioned about said housing inlet and the innermost end of which is extended to rim said inlet to said impeller and define thereby an initial portion of a flow passage through said housing which is continued by way of said impeller through an extension of said flow passage defined by said volute structure the discharge end of which is in direct communication with said housing outlet.

10. A pump as in claim 9 wherein at least one of said generally annular plate-like structures has integrated therewith at least a portion of said volute structure and said volute structure and said annular plate-like structures are interconnected to form a housing for said impeller peripheral wall portions of which are provided by said volute structure.

11. A pump as in claim 9 wherein resilient buffer means are interposed between relatively adjacent portions of said impeller and said annular plate-like structures.

12. A pump as in claim 9 wherein a seal is interposed between said tubular wall segment in connection with the base of said second cup-shaped half of said housing and said second annular plate-like structure, said seal including a portion which overlaps and extends peripheral to the projected extremity of said tubular wall segment and a radially projected portion arranged to provide a continuing seal during breathing and expansion of said pump.

13. A pump comprising a housing having an inlet thereto and an outlet therefrom, said housing including a pair of cup-shaped parts the lips of which are placed in connected relation to form said housing, one of said cup-shaped parts being adapted for connection to a prime mover and including in the base thereof an opening for the projection therethrough of a drive shaft of said prime mover as said one housing part is coupled to said prime mover, said opening for said drive shaft being defined by a tubular wall structure which projects inwardly of and generally perpendicular to said base, a first generally annular plate-like structure positioned in abutment with a portion of the inwardly projected extremity of said tubular wall structure to have the position of said annular plate-like structure defined thereby, an impeller releasably coupled to said drive shaft, said impeller including a shroud plate extending in overlapping relation to the inner peripheral portion of said annular plate and in capping relation to the inner projected extremity of said tubular wall structure, said impeller having a plurality of vanes projected from and generally perpendicular to the surface thereof which is remote from said annular plate-like structure, a second generally annular plate-like structure positioning in a capping relation to the projected extremities of the vanes of said impeller, volute structure positioned between and laterally confined by said generally annular plate-like structures, said volute structure being in peripherally encompassing relation to said impeller and forming at least one generally spiral passage open to the discharge side of said impeller having its discharge end in communication with said housing outlet, the central opening in the second of said annular plates defining an inlet to said impeller, the other said cup-shaped part of said housing including in a base portion thereof said housing inlet, means in connection with said base portion of said second cup-shaped part of said housing defining a tubular wall segment the outermost end of which is positioned about said housing inlet and the innermost end of which is extended to rim said inlet to said impeller and define thereby an initial portion of a flow passage through said housing which is continued by way of said impeller through an extension of said flow passage defined by said volute structure the discharge end of which is in direct communication with said housing outlet, said tubular wall structure defining an opening for said drive shaft including in connection therewith a short inwardly directed generally annular web having formed integral therewith a short tubular wall structure, said short tubular wall structure being arranged to provide a pair of shoulders which face in respectively opposite directions, said shoulders providing abutment surfaces for end spaced seals positioned in surrounding relation to said drive shaft and defining between the adjacent ends thereof a generally annular chamber, and a passage through said short tubular wall structure, said web and said first mentioned tubular wall structure accommodating in connection therewith one end of a flexible resilient tube which is open to said annular chamber, said tube containing a supply of lubricant and having the opposite end thereof supported in connection with said housing, the arrangement of said tube in connection with said annular chamber providing that said pump is self-lubricating, lubricant being communicated with said annular chamber in correspondence with the pressure developed within the housing of said pump by materials being discharged therefrom by way of said housing outlet.

14. A pump particularly advantageous for use in evacuating liquids and solids from a given location comprising a pump housing having an inlet thereto and an outlet therefrom, an impeller within said pump housing, said housing having an opening accommodating the projection therein of a drive shaft arranged to mount said impeller interiorly of said housing, means defining a flow passage through said housing one end of which includes said inlet and the other said outlet, said impeller being positioned within and intermediately of the ends of said flow passage, said means defining a flow passage including, as a part thereof, means forming a housing for said impeller, said impeller housing being held interiorly of said pump housing by means projecting from opposite wall portions of said pump housing, means being interposed between at least a portion of said projecting means and said impeller housing to accommodate axial movement of said impeller housing to a slight degree, in a shock absorbing fashion, said impeller housing having an opening to the eye of said impeller in direct communication with said pump housing inlet and at least one further opening on the discharge side of said impeller which is in direct communication with said pump housing outlet.

15. A pump particularly advantageous for use in evacuating liquids and solids from a given location comprising a pump housing having an inlet thereto and an outlet therefrom, an impeller within said pump housing, said pump housing having an opening accommodating the projection therein of a drive shaft arranged to mount said impeller interiorly of said housing, means defining a flow passage through said housing one end of which includes said inlet and the other said outlet, said impeller being positioned within and intermediately of the ends of said flow passage, said means defining a flow passage including, as part thereof, means forming a housing for said impeller having openings which on drive of said impeller enables said impeller to draw liquids and solids thereto by way of said pump housing inlet and discharge the same by way of said pump housing outlet, said pump housing being comprised of two generally cup-shaped parts the lips of which are secured in a directly opposed relation, means projecting from opposite wall portions of said pump housing respectively connected to the base portions of said parts and having the form of tubular wall segments, means interposed to form a resilient seal between the inward projected extremity of one of said tubular wall segments and means rimming one of said openings in said impeller housing which defines an inlet thereto, said interposed means accommodating axial movement of said impeller housing to a slight degree, in a shock absorbing fashion, the other of said tubular wall segments providing at its projected extremity a mount for said impeller housing accommodating rotative adjustment thereof, additional means being provided to form a resilient connection between said impeller housing and a portion of said pump housing to restrain said impeller housing from rotative movement while accommodating shock applied thereto.

16. A pump as in claim 15 wherein means formed integral with the inner wall surface of said cup-shaped parts include a portion providing shoulders limiting the axial position of said impeller housing, in one sense, in the assembly thereof.

17. A pump particularly advantageous for use in evacuating liquids and solids from a given location comprising a pump housing having an inlet thereto and an outlet therefrom, said pump housing being comprised of two generally cup-shaped parts the lips of which are secured in a directly opposed relation, an impeller, said pump housing having an opening accommodating the projection therein of a drive shaft arranged to mount said impeller interiorly of said pump housing, means defining a flow passage through said pump housing one end of which includes said inlet and the other said outlet, a housing for said impeller included in said means defining a flow passage, said impeller housing being held interiorly of said pump housing by tubular wall segments projecting from the opposite cup-shaped parts of said pump housing, said impeller housing having an opening to the eye of the impeller in direct communication with said pump housing inlet and at least one further opening on the discharge side of said impeller which is in direct communication with the pump housing outlet, means interposed to form a resilient seal between the inwardly projected extremity of one of said tubular wall segments and means rimming the opening to the eye of the impeller to accommodate axial shock absorbing movement of said impeller housing, the other of said tubular wall segments providing at its projected extremity a mount for said impeller housing accommodating relative adjustment thereof, means forming a resilient connection between said impeller housing and a portion of said pump housing to restrain said impeller housing from rotative movement while accommodating shock applied thereto, said impeller housing comprising axially spaced base plate portions of annular configuration and volute structure therebetween which forms peripheral wall portions of said impeller housing and said one further opening on the discharge side of said impeller, said impeller housing being split in two parts, in an axial sense, one part of said impeller housing having a central aperture in its base portion accommodating a reduced inner end portion of said other of said tubular wall segments which rims an opening in the base of the cup-shaped housing portion of which it forms a part through which is projected the drive shaft for said impeller, a sleeve-like element mounted about and in connection with said drive shaft and projected inwardly of said impeller housing to have its innermost end substantially coplanar with the innermost end of said drive shaft, said impeller including a shroud plate having a central aperture the cross sectional area of which is less than that of the inner end surface of said shaft, said shroud plate having its central aperture centered on said inner end surface of said shaft, an internally threaded tubular element reduced in external diameter to one end which is abutted to said inner end surface of said shaft and rimmed by said shroud plate, a shoulder being provided by the reduction in external diameter of said tubular element overlapping and confining the inner peripheral edge portion of said shroud plate, about the central aperture therein, and a screw the head of which clamps said internally threaded tubular element and thereby said shroud plate to the inner end surface of said shaft as the body thereof projects through and in spaced relation to said tubular element and is threadedly engaged in said inner end surface of said shaft, the arrangement providing that in the event the release of said screw does not enable a free removal of said tubular element and said shroud plate then one may apply and threadedly engage a larger diameter screw to the inner wall of said tubular element and against the inner end of said shaft to jack the tubular element and said impeller free of said shaft.

18. A pump including a housing having an inlet thereto and an outlet therefrom, means defining a flow passage in said housing leading from said inlet to said outlet, an impeller within said flow passage between said inlet and said outlet, means defining a housing for said impeller defining a part of said flow passage including an inlet to communicate said impeller with said pump housing inlet and an outlet to communicate said impeller with an exit chamber defined in said pump housing which is in direct communication with said pump housing outlet, said pump and impeller housings having aligned openings accommodating the projection therein of a drive shaft connecting to said impeller, the opening in said pump housing accommodating the projection therein of said drive shaft being rimmed by a tubular wall segment in connection with said pump housing, longitudinally spaced seal means about said shaft defining therewith and with said tubular wall segment an annular chamber about said shaft to which there is an opening through said tubular wall segment, a receptacle holding a supply of lubricant within said exit chamber and exposed therein to the pressure of liquids and/or solids moving to and through said exit chamber to said outlet under the influence of said impeller which is driven by said shaft, a wall portion of said receptacle being pressured thereby and arranged to induce a pressured flow of lubricant from said receptacle to said annular chamber to maintain therein a required amount of lubricant during and in correspondence with the operation of said pump.

* * * * *

UNITED STATES PATENT AND TRADEMARK OFFICE

CERTIFICATE OF CORRECTION

PATENT NO. : 4,202,654

DATED : May 13, 1980

INVENTOR(S) : Alfred S. Marlow

It is certified that error appears in the above-identified patent and that said Letters Patent are hereby corrected as shown below:

Col. 3, line 34, "1" is corrected to read -- 10 --.

Col. 6, line 15, "of" (second occurrence) is corrected to read -- or --.

Col. 7, line 38, following "front", insert -- half --.

Col. 8, line 10, "and" is corrected to read -- end --;

line 50, "nothing" is corrected to read -- noting --.

Col. 14, line 64, "of" is corrected to read -- on --.

Col. 19, Claim 1, line 4, following "lubricant", insert -- therein --.

Col. 19, Claim 2, line 20, delete "means placing";

line 21, following "means", insert -- is --.

Col. 23, Claim 14, line 36, insert -- pump -- after "said".

Signed and Sealed this

*Ninth* Day of *September 1980*

[SEAL]

*Attest:*

SIDNEY A. DIAMOND

*Attesting Officer*

*Commissioner of Patents and Trademarks*